United States Patent [19]

Amarakoon

[11] Patent Number: 4,595,190

[45] Date of Patent: Jun. 17, 1986

[54] BOTTOM SHEET SEPARATOR-FEEDER

[75] Inventor: Kiri B. Amarakoon, Letchworth, England

[73] Assignee: Xerox Corporation, Stamford, Conn.

[21] Appl. No.: 534,003

[22] Filed: Sep. 20, 1983

[30] Foreign Application Priority Data

Sep. 21, 1982 [GB] United Kingdom ..... 8226839

[51] Int. Cl.[4] ..... B65H 3/12; B65H 3/46

[52] U.S. Cl. ..... 271/94; 271/3.1; 271/161; 271/166

[58] Field of Search ..... 271/94, 3.1, 95, 96, 271/98, 161, 165, 166, 196, 197, 209, 19, 20, 35; 198/837, 840

[56] References Cited

U.S. PATENT DOCUMENTS

| | | | |
|---|---|---|---|
| 2,987,314 | 6/1961 | Monaghan | 271/197 |
| 4,269,406 | 5/1981 | Hamlin | 271/108 |
| 4,270,746 | 6/1981 | Hamlin | 271/98 |
| 4,275,877 | 6/1981 | Silverberg | 271/166 |
| 4,284,270 | 8/1981 | Silverberg | 271/166 |
| 4,305,576 | 12/1981 | Hamlin | 271/11 |
| 4,313,599 | 2/1982 | Lohr | 271/166 |

*Primary Examiner*—Bruce H. Stoner, Jr.
*Assistant Examiner*—Lawrence J. Goffney, Jr.
*Attorney, Agent, or Firm*—William A. Henry, II

[57] ABSTRACT

A bottom sheet separator-feeder for separating and forwarding sheets seriatim from the bottom of a stack of sheets includes a stack tray and endless vacuum belts extending through the front end of the tray for acquiring and advancing the bottom sheet, the belts extending across a support surface having vacuum ports therein for applying a negative pressure at the back of the belts. In order to reduce unwanted vacuum effects upstream of the vacuum ports, a transverse lip extends across the support surface upstream of the vacuum ports.

6 Claims, 6 Drawing Figures

BOTTOM SHEET SEPARATOR-FEEDER

This invention relates to bottom sheet separator-feeders for separating and forwarding sheets seriatim from the bottom of the stack of the sheets. The invention is particularly concerned with such separator-feeders which include vacuum belt means for performing the separating and forwarding functions.

Figure 4:
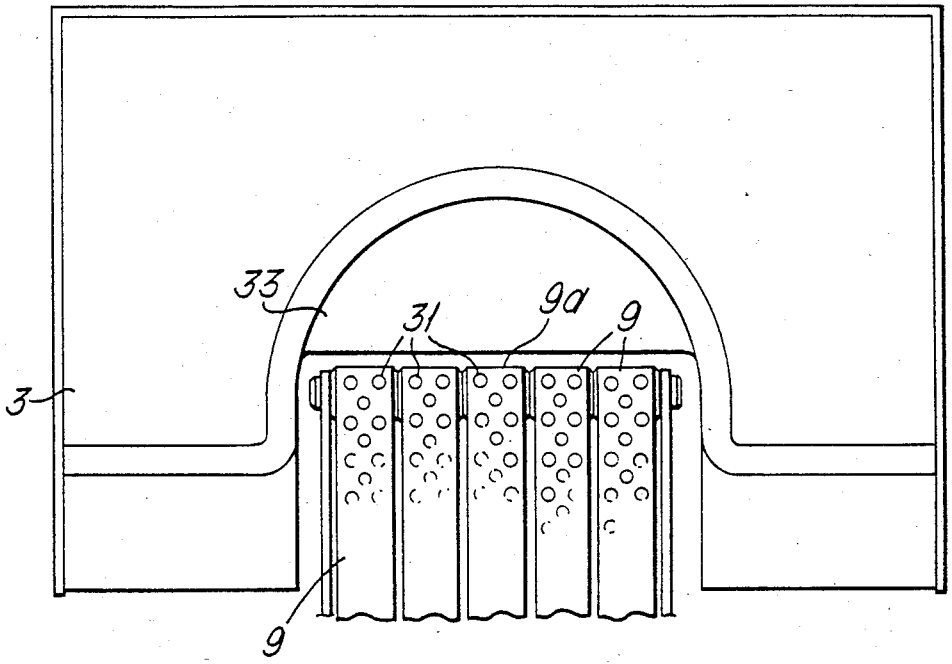

U.S. Pat. Nos. 4,269,406, 4,270,746, 4,275,877, 4,284,270, 4,305,576 and 4,313,599 disclose bottom sheet separator-feeders for separating and forwarding sheets seriatim from the bottom of the stack of sheets to be fed, comprising a stack tray for supporting a stack of sheets to be fed, and endless vacuum feed belt means extending through at least the front end of the sheet stack tray for acquiring and advancing the bottom sheet of the stack, said belts extending across a support surface having vacuum ports therein for applying a negative pressure at the back of the belt means. Normally the sheets are fed into a pair of take-away feed rolls by the vacuum belts and once the sheet has been acquired by the take-away rolls, the vacuum is shut off by a valve between the ports and the source of negative pressure. It has been found however that when a sheet has been partially fed from a system as shown in FIG. 4, a leakage path between the support surface and the belt produces a vacuum effect upstream of the ports which may be sufficient to acquire the second sheet in the stack causing it to be advanced with respect to the rest of the stack. Particularly where the valve for the vacuum ports is controlled by a timer this can lead to increasing shingling of the stack with the eventual result of misfeeds.

It is an object of the present invention to overcome this problem and to this end the invention is characterised in that a lip extends across the support surface normally to the direction of movement of the feed belt means upstream of the vacuum ports to reduce or prevent air flow through the belt means upstream thereof. It has been found that the provision of such a lip is effective substantially to prevent feed failures and multifeeds.

In a preferred form the stack tray has a U-shaped pocket formed therein and a plurality of vacuum feed belts are disposed in the pocket beneath the tray and adapted to pull the bottom sheet in the stack into the pocket and feed the sheet from beneath the sheet stack. Preferably a portion of the centre belt of the vacuum feed belts is spaced slightly above the remaining belts such that when the bottom sheet in the stack is pulled into contact with the belts, a temporary corrugation is formed in the sheet. This centre belt is suitably raised by passing over a raised portion of the support surface. In a preferred embodiment the centre belt is not a vacuum belt and the transverse lip of this invention extends across the support surface up to the opposite sides of the raised surface portion over which the centre belt passes.

Figure 1:
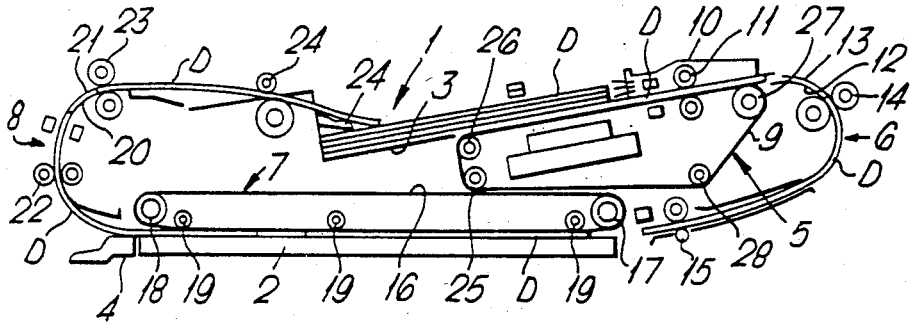
Figure 2:
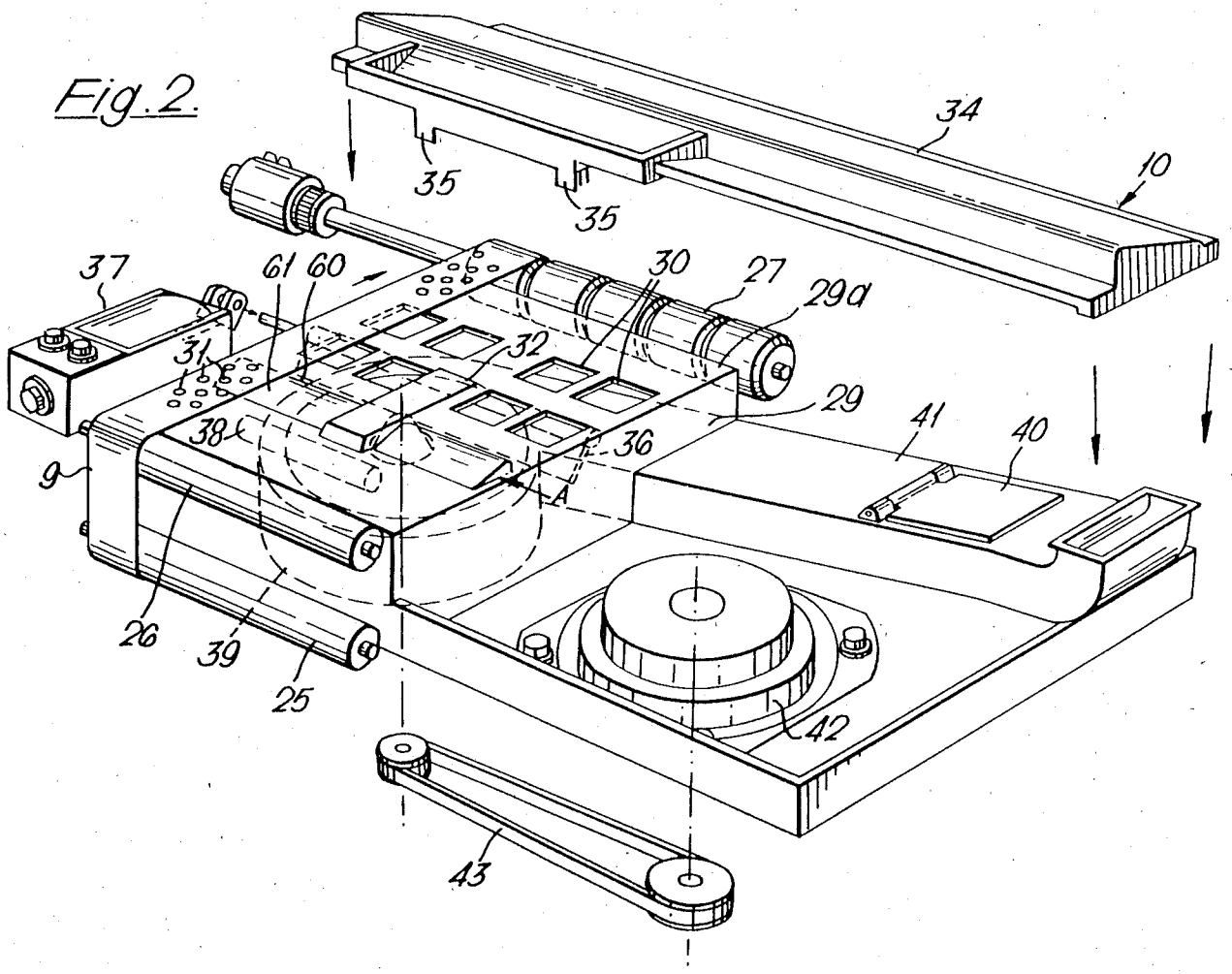
Figure 3:
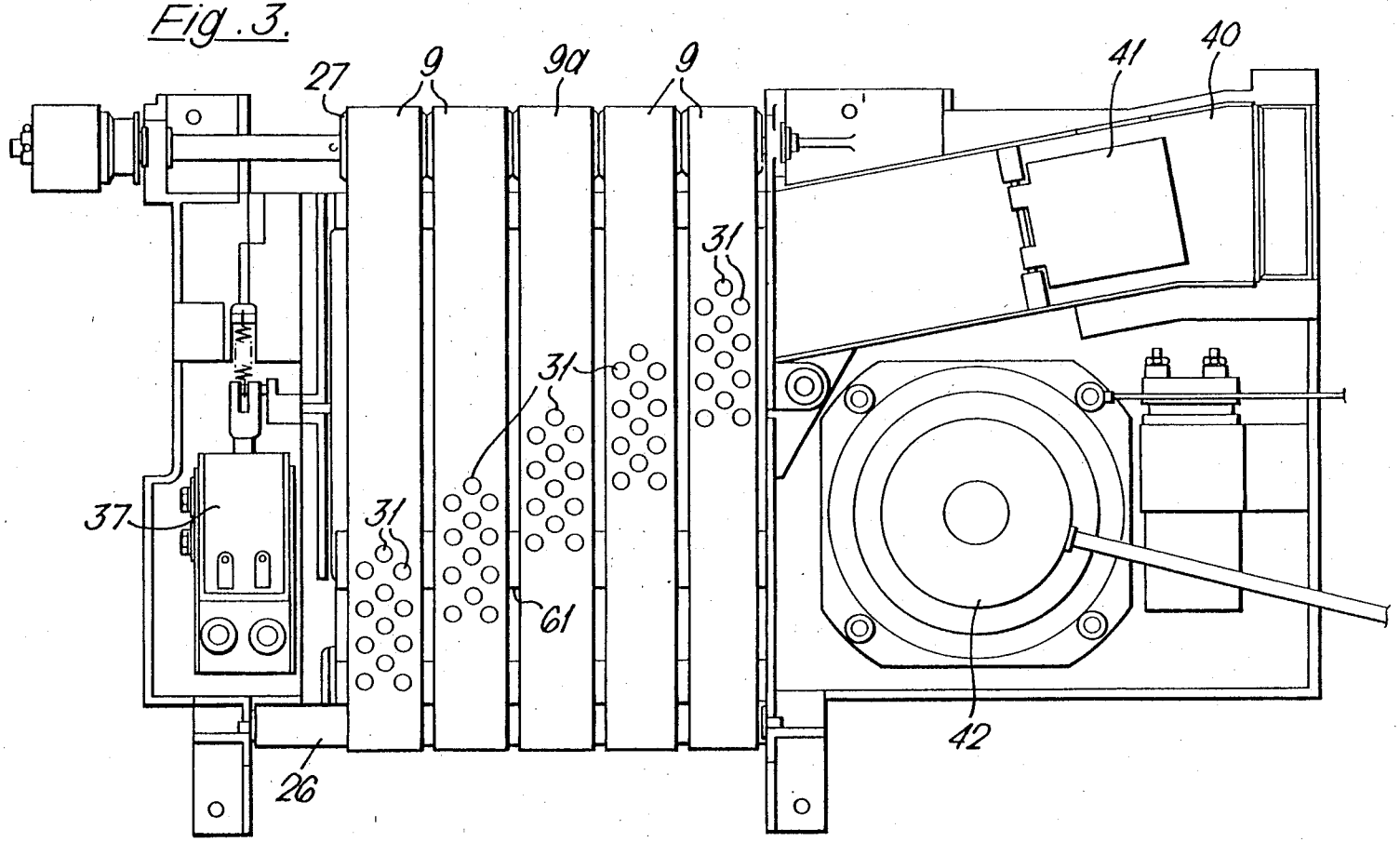
Figure 5:
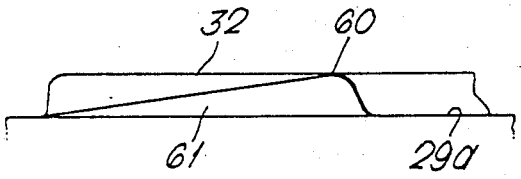
Figure 6:
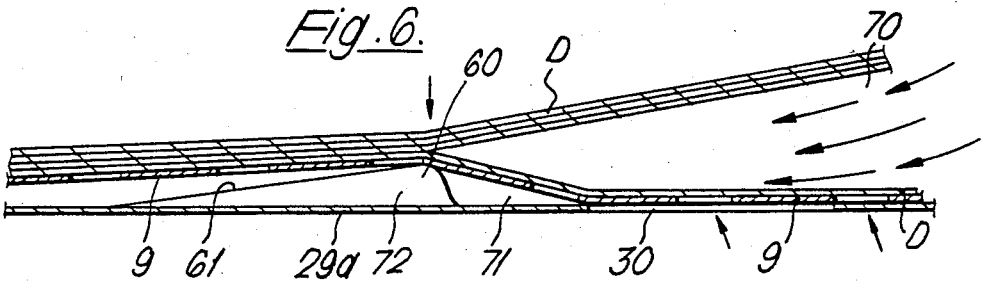

In order that the invention may be more readily understood reference will now be made to the accompanying drawings, in which:

FIG. 1 is a schematic side view of a document handler incorporating a bottom sheet separator-feeder according to the invention, FIG. 2 is a perspective view, partly exploded, of the separator feeder mechanism of the document handler of FIG. 1, FIG. 3 is a top plan view of the separator feeder, FIG. 4 is a top view of the document tray and feed belts of the document handler, FIG. 5 is a scrap view in the direction of arrow A of FIG. 2 showing a detail, and FIG. 6 is another scrap view in the direction of arrow A illustrating a feature of the operation of the separator feeder.

Referring to the drawings, there is illustrated an automatic document handler 1 for installation above the exposure platen 2 of a xerographic reproduction machine. The document handler includes a storage tray 3 for a stack of documents D to be copied and document circulating means for delivering the documents in turn to the platen from the storage tray and for returning the documents to the tray, whereby the documents may be circulated and recirculated in sequence past the platen for repeated copying (precollation mode). The documents may either be transported across the platen at a constant velocity past the optical system (not shown) of the photocopier which is held stationary with its scanning slit under the entry end of the platen, or instead they may be registered on the platen prior to copying and the stationary document exposed by scanning the optical system across the document. For this purpose a registration member or gate 4, which can be moved in and out of sheet blocking position at the registration edge of the platen by means of a conventional solenoid type actuator, is provided for registering the document in stationary position on the platen 2 while the optical system is scanned across the document. When the document is registered on the platen, the document handler can be operated in so-called stacks mode wherein each document is copied a plural number of times during a single delivery to the platen.

The document handler comprises, in addition to the document tray 3, a document separator/feeder 5, a pre-platen transport 6 for conveying documents to the platen, a platen transport 7 and a post-platen transport 8 by which documents are returned to the document tray.

The document storage tray 3 is mounted over the platen 2 and slopes upwardly towards the separator/-feeder 5; it is adjustable to accommodate different document sizes.

Sheet separation and acquisition is accomplished by a vacuum belt corrugation feeder (VCF) 5 using flotation pressure differences between the bottom sheet and the sheets above, sheet corrugation and vacuum, a U-shaped (parabolic or semi-circular) contour pocket being cut out at the lead edge of the tray 3 and dished down in the manner shown and described for example in U.S. Pat. No. 4,275,877. Documents placed in the tray, bridge this gap and form a flotation pocket. Transport belts 9 surface through the document tray within the contour pocket. Document stack flotation is accomplished by a frontal assault of air from an air knife 10. The air jet impinges on the tray just in front of the lead edge of the document stack; this permits volumetric flow expansion of air within the pocket contour of the tray and also riffles the front edge of the documents to allow a diffential pocket of air between the bottom sheet and the next sheet. This assists in the acquisition, separation and feeding of the bottom document.

The vacuum belt corrugation feeder mechanism 5 acquires and corrugates the bottom document D in the stack and forwards the document to take away roll pair 11 after the air knife 10 has had time to separate the bottom sheet from the rest of the stack. The document is then fed by take-away rolls 11 through pre-platen transport 6 which comprises inner and outer inversion guides 12, 13 and feed roll pairs 14 and 15. Transport of the document across the platen 2 is by a single white, wide friction drive belt 16 entrained over input and output rollers 17, 18. Three gravity rolls 19 apply a nip between the belt 16 and platen 2 and maintain drive across the platen. The post-platen transport 8 by which the document is returned to the document tray 3 after exposure comprises inner and outer inversion guides 20, 21 and feed roll pairs 22, 23 as well as a re-entry roll pair 80 for driving the documents back into the tray.

The document handler is also provided with a sheet separator finger 24 as is well known in the art to separate the documents to be fed from those documents returned to the document handler. Upon removal of the last document from beneath sheet separator finger 24, the finger 24 drops through a slot provided in the tray, suitable sensors are provided to sense that the last document in the set has been removed from the tray and the finger is then rotated in a clockwise direction to again come to rest on the top of the documents in the stack prior to subsequent recirculation of the document set.

Referring more particularly to FIGS. 2, 3 and 4 wherein the document separator-feeder 5 is more clearly illustrated, there is disclosed a plurality of feed belts 9 supported for movement on feed belt rolls 25, 26, 27 and 28. Spaced within the run of the belts 9 there is provided a vacuum plenum 29 having vacuum openings or ports 30 therein adapted for cooperation with perforations 31 in the belts 9 to provide a vacuum for pulling the bottom document in the document stack onto the belts 9. There are five rubber vacuum belts 9, the centre belt **9*a* being raised 2 mm above the four outer belts. This produces the corrugation when the document is pulled down by the vacuum. The frequency and size of the holes in the belts 9 regulates the volume of air that can be drawn through them. The transport belts 9 move across the top plate 29*a* of a vacuum plenum 29 which has the open slots or vacuum ports 30 in it coincident with the perforations in the belts. Once again the frequency and size of these slots 30 regulates the volume of air that can be drawn into the vacuum chamber beneath. Preferably no ports 30 are aligned with the centre belt 9*a* although it may for convenience of manufacture have the perforations 31** therein.

As can be seen from FIG. 2, the top plate **29*a* of the vacuum plenum chamber 29 is provided with a raised portion or ramp 32, 2 mm high, which lifts the centre belt 9*a* so that upon capture of the bottom document in the stack against belts 9, the center corrugation will be produced in the bottom sheet. Since the belts 9 extend through a dished portion or pocket 33 of document tray 3 so that they are below the surrounding support surfaces of the tray, the document is corrugated into a double valley configuration. The flat surfaces of the vacuum belts 9 on each side of the raised centre belt 9*a* generate a region of maximum stress in the document which varies with the document beam strength. in the unlikely event that more than one document is pulled down into contact with the feed belts, the beam strength of the second document resists the corrugating action; thus gaps are opened between sheets one and two which extend to their lead edges. These gaps and channels reduce the vacuum levels between sheets one and two due to porosity in sheet one and provide for entry of the separating air flow from the air knife. The air knife 10 comprised of pressurised air plenum 34 having a plurality of air jet openings 35 is provided to inject air into the pocket formed between the document pulled down against the feed belts 9 and the documents thereabove to provide an air cushion or bearing between the stack and the bottom document to minimize the force necessary for removing the bottom document from the stack. It can be understood that if two documents are pulled down toward the belts 9**, since the top sheet would not be corrugated, the air knife would inject air into the space between the two documents and force the second document off from the raised belt back toward the document stack.

The sidewalls of the document tray 3 are vented to allow air to escape and prevent arched inflation of the stack with its resultant multifeeds. The trail edge of the tray is also vented to improve sheet stability and turbulent lift of document trail edges.

To further increase the efficiency of the system, the document tray 3 is, as mentioned above, provided with a rearward tilt as seen in FIG. 1. When flotation air is provided under the stack or between the first and second sheets, gravity will allow the sheets to settle or float back against the rear tray wall. Thus, the sheet being removed is pulled uphill while gravity helps hold the remainder of the sheets back, helping to prevent multifeeds.

Within the vacuum plenum chamber 29 is housed a vacuum flap valve 36 which regulates the timing of the vacuum through the slots 30 in the top plate and belts and hence the acquisition timing of documents. The valve 36 is actuated by a shaft which passes through the side wall of the vacuum housing and is attached to a solenoid 37. A vacuum relief valve 38 is also positioned in one of the vacuum chamber side walls. It is actuated by the chamber pressure, and allows air to the air knife 10, when a document has been acquired by the vacuum transport and effectively closed off the inlet ports 30 to the vacuum chamber 29.

Beneath the vacuum chamber is a scroll-shaped impeller housing 39 containing an impeller. The impeller is driven by a motor 42 through a belt drive 43. Air drawn through the vacuum transport belts 9 and the vacuum chamber 29 is exhausted and ducted to the air knife 10 which is located above the lead edge of the document tray. A pressure relief valve 40 is situated in the duct 41 to control air knife pressure which would otherwise cause document 'blow away' prior to the closed inlet port condition.

By suitable controls, it is desirable to provide a delay between the time the vacuum is applied to pull the document onto the belt and the start up of the feed belts to assure that the bottom document is captured on the belt before belt movement commences and to allow time for the air knife 10 to separate the bottom sheet from any sheets that were pulled down with it.

As explained above, when the bottom document is pulled into the pocket 33 and corrugated, an envelope type opening or pocket 70 is created between the bottom sheet and the remainder of the sheets in the stack. Air injected into this space from the air knife 10 produces an air bearing between the bottom sheet and the remainder of the stack to allow easy removal of the bottom sheet from beneath the stack. Flow of air from the pocket is restricted by a partial seal or flow restriction caused by supporting the major portion of the stack weight on the edge portions of the tray surrounding the pocket. It has been found, however, that when a sheet has been partially fed a leakage path between the support surface of the tray within the pocket or depression 33 and the belts produces a vacuum effect upstream of the ports 30, in effect turning all the belt perforations 31 into vacuum ports. This can be beneficial as it assists feed out of the bottom sheet but as soon as the second sheet is exposed to the moving transport belts it may also be advanced with respect to the rest of the stack by a distance dependent upon the point at which the vacuum can be switched off without deleteriously affecting feeding of the bottom sheet. In order to overcome this problem, in accordance with the present invention, a transverse lip 60 extends across the top plate of the vacuum plenum chamber 29. The lip 60 is formed at the front edge of a ridge 61 which extends up to opposite sides of the ramp 32 and is generally triangular in cross-section, sloping upwardly in the feed direction towards the lip 60 from the rear end of the ramp 32 so that the ramp and ridge together form a T-shape in top plan view. In one embodiment in which the ramp 32 is 52 mm long and 2 mm high, the top surface of the ridge slopes upwardly towards the lip 60 at an angle of 8° from the rear end of the ramp 32 to a length of approximately 17 mm. The rear end of the ramp may be as shown in FIGS. 2 and 5 or its rear portion may slope in conformity with the ridge 61.

Referring particularly to FIG. 6 it will be seen that the air levitation pocket 70 between the bottom sheet and the next sheet extends up to the lip 60 and the vacuum belts 9 are entrained over the lip 60 to form pockets or gaps 71, 72 in front of and behind the lip. These gaps are too wide for high vacuum levels to be achieved so that in effect a significant vacuum level does not exist and the second sheet is not influenced by the vacuum flow or the belt movement.

At the same time a better sealing effect is created at the rear of the air pocket 70 between the bottom and second sheets which assists in overcoming the effects of sheet to sheet attraction caused by static or surface texture by the creation of a greater initial pressure level within the air pocket 70.

Although a particular embodiment has been described it will be understood that various modification may be made to the specific details referred to herein without departing from the scope of the invention as defined in the appendant claims. For example while the vacuum separator feeder is described in the environment of a document handler it may be used for feeding sheets in other environments.

What is claimed is:

1. A bottom sheet separator-feeder for separating and forwarding sheet seriatim from the bottom of a stack of sheets to be fed, comprising a stack tray for supporting a stack of sheets to be fed, apertured endless vacuum feed belt means extending through at least the front end of the sheet stack tray for acquiring and advancing the bottom sheet of the stack, said belt means extending across a support surface having vacuum ports therein for applying a negative pressure at the back of and through the belt means, lip means extending across the support surface normally to the direction of movement of the feed belt means upstream of the vacuum ports to reduce or prevent air flow through the apertures in said belt means upstream of said ports.

2. A bottom sheet separator-feeder according to claim 1, wherein said belt means includes a plurality of vacuum feed belts and in which the stack tray has a generally U-shaped pocket formed therein and said vacuum feed belts are disposed in the pocket beneath the tray so as to pull the bottom sheet in the stack into the pocket and feed the sheet from beneath the stack.

3. A bottom sheet separator-feed according to claim 2, in which a portion of a centre belt of said plurality of vacuum feed belts is spaced slightly above the remaining belts such that when the bottom sheet in the stack is pulled into contact with the belts, a temporary corrugation is formed in the sheet.

4. A bottom sheet separator-feeder according to claim 3, in which the centre belt passes over a raised portion of the support surface.

5. A bottom sheet separator-feeder according to claim 4, in which said lip means extends in a transverse direction across the support surface up to opposite sides of said raised support surface position.

6. A bottom sheet separator-feeder according to claim 3, in which no vacuum ports are aligned with the centre belt.

* * * * *